US006029493A

United States Patent [19]

Maier et al.

[11] Patent Number: 6,029,493

[45] Date of Patent: Feb. 29, 2000

[54] DEVICE FOR HEMMING OF SHEET METALS, PARTICULARLY OF COACHWORK SHEET METALS IN AUTOMOBILE MANUFACTURE

[75] Inventors: Josef Maier, Wadem; Andreas Schmidt, deceased, late of Marpingen, both of Germany, by Robert Leist, executor

[73] Assignee: Thyssen Industrie AG

[21] Appl. No.: 09/178,563

[22] Filed: Oct. 23, 1998

[30] Foreign Application Priority Data

Oct. 25, 1997 [DE] Germany ..... 197 47 291

[51] Int. Cl.[7] ..... B21D 5/04

[52] U.S. Cl. ..... 72/312; 72/323

[58] Field of Search ..... 72/312–315, 323, 72/453.13; 267/119; 100/269.04

[56] References Cited

U.S. PATENT DOCUMENTS

| | | | |
|---|---|---|---|
| 1,405,799 | 2/1922 | Paul | 72/456 |
| 2,294,676 | 9/1942 | MacMillin | 72/312 |
| 3,190,215 | 6/1965 | Howard | 100/269.04 |
| 5,150,508 | 9/1992 | St. Denis | 29/243.5 |
| 5,454,261 | 10/1995 | Campian | 72/323 |

FOREIGN PATENT DOCUMENTS

| | | | |
|---|---|---|---|
| 1322218 | 2/1963 | France | 72/323 |
| 1445675 | 6/1965 | France . | |
| 1 155 414 | 10/1963 | Germany . | |
| 43 30 683 C2 | 7/1995 | Germany . | |
| 677 620 A5 | 6/1991 | Switzerland . | |
| 2 224 681 | 6/1990 | United Kingdom . | |

*Primary Examiner*—Daniel C. Crane
*Attorney, Agent, or Firm*—McGlew and Tuttle, P.C.

[57] ABSTRACT

A device for hemming of sheet metals, particularly of coachwork sheet metals in automobile manufacture, wherein a driven ram with superposed hemming bed arranged in a base rack presses the sheet metals to be hemmed against stationary hemming tools. The working stroke and the force for hemming of sheet metals is pneumatically transmitted to ram by the aid of a compressed-air cushion arranged between base rack and ram.

12 Claims, 1 Drawing Sheet

DEVICE FOR HEMMING OF SHEET METALS, PARTICULARLY OF COACHWORK SHEET METALS IN AUTOMOBILE MANUFACTURE

FIELD OF THE INVENTION

The invention relates to a device for hemming of sheet metals, particularly of coachwork sheet metals in automobile manufacture, wherein a ram nested in a base rack and provided with a superposed hemming bed presses the sheet metals to be hemmed against stationary hemming tools.

BACKGROUND OF THE INVENTION

In a conventional hemming device incorporating state-of-art technology, the hemming stroke and the required hemming force are applied through a hydraulic cylinder lying centrally under the ram. The ram with the superposed hemming conveys the sheet material to be hemmed against the stationary pre-hemming and/or finishing tools which are affixed to slideable or swingable devices, such as described in U.S. Pat. No. 5,150,508, and DE 43 30 683 C2, and hereby incorporated by reference. Owing to the central introduction of forces in the center of the ram, the ram as a whole must be of a very stable construction in order to be capable of transferring the hemming force from the center to particularly the edge zone of the ram.

SUMMARY AND OBJECTS OF THE INVENTION

It is therefore the primary task of the present invention to improve the drive for the ram in such a manner that design and construction are simplified.

The solution to this task is provided by a device for hemming of sheet metals, where the device includes a base rack, a ram arranged in the base rack, and a hemming bed superposed on the ram. A compressed air cushion is arranged between the base rack and the ram for pneumatically transmitting a working stroke and a hemming force to the ram for hemming sheet metals against stationary hemming tools.

Based on the proposal being the subject of this invention a compressed-air cushion is employed to serve as ram drive in order to be able to apply the working stroke and the force for hemming of sheet metals pneumatically. The compressed-air cushion is mounted between the base frame and the ram. In particular it may be located in the base frame and take at least the whole ground area of the ram. By use of the compressed-air cushion the force is more favorably introduced via a folded edge located at the periphery of the ram so that the ram is substantially simplified in its external shape and dimensions. In contrast with a centrally attacking hydraulic cylinder the ram of the present invention just needs to have only small stiffening ribs because the hemming force need not be introduced any longer from the center to the edge zone of the ram. Moreover it is feasible to accommodate the compressed air cushion in a standardized substructure of the base rack of the hemming device. The compressed-air cushion is not only fixed through its embodiment into the base rack, but also through the ram, and it is guided via several guide strips spread at the periphery in the direction of ram movement in the base rack. To confine the hemming stroke, arrest stops projecting outwardly at the ram periphery, possibly adjustable for adjustment of the hemming may be arranged in appropriate recesses of the base rack. To connect a compressed-air hose to the compressed-air cushion, it is moreover feasible to provide an appropriate passage port in the base plate of the ram so that the compressed-air hose is not only conducted through the base frame, but from the top through a passage port which is preferably arranged centrally.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
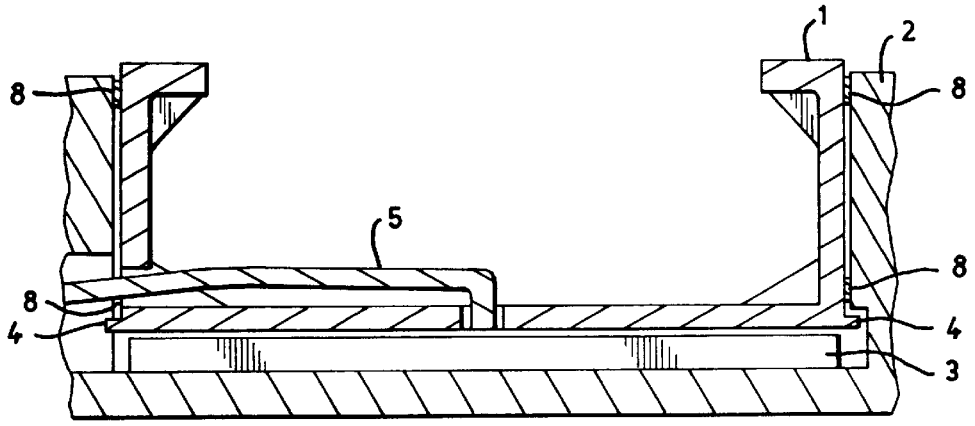
FIG. 1 is a view of a compressed-air cushion 3 with ram 1 and base rack 2 pursuant to the proposal being the subject of this invention.

Referring to the drawings, FIG. 1 illustrates the compressed-air cushion 3 lying in base rack 2 and being fixed with compressed-air hose 5 at ram 1. Ram 1 is conducted via several short guide strips 8 in base rack 2. Arrest stops 4 serve for restriction of the hemming stroke and can be harmonized and/or adjusted for hemming adjustment. The force is introduced through a folded edge 10 located at the periphery of ram 1.

Figure 2:
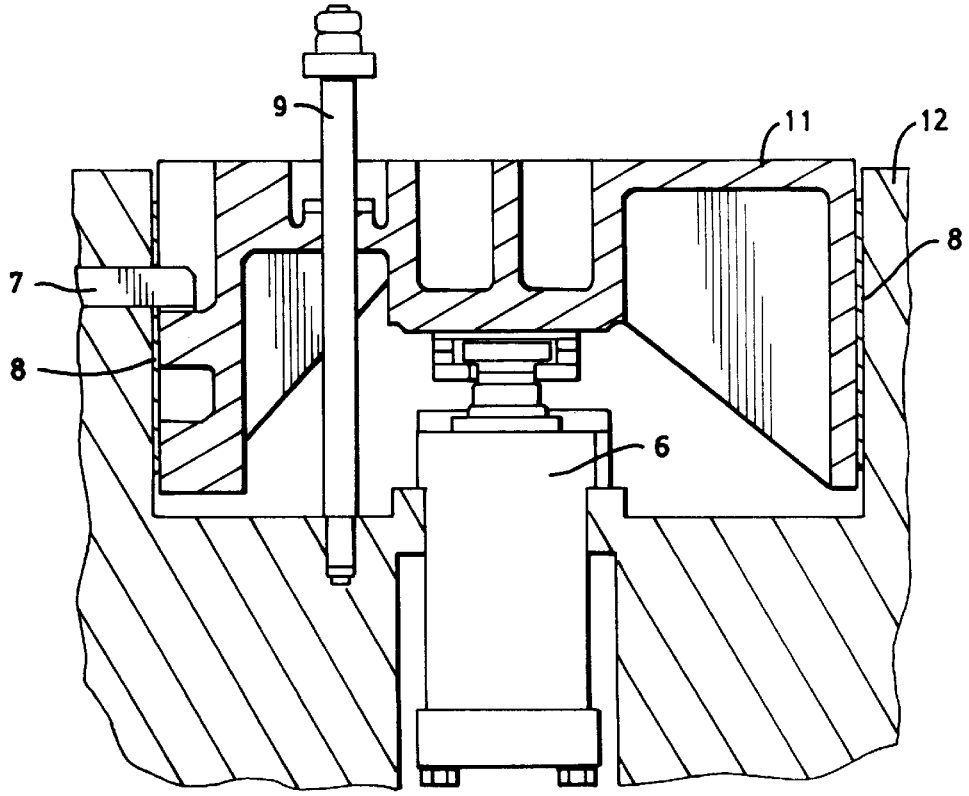
FIG. 2 (PRIOR ART)
FIG. 2 is a view of a hydraulic cylinder 6 with ram 11 in the base rack 12 in a conventional style of design and construction incorporating state-of-the-art technology.

FIG. 2 illustrates a construction style incorporating state-of-the-art technology with hydraulic cylinder 6. Here, long guide strips 8 are employed to guide ram 11 in base rack 12. Moreover, to confine the various hemming positions, pegs 7 and pull anchor 9 are applied here.

While specific embodiments of the invention have been shown and described in detail to illustrate the application of the principles of the invention, it will be understood that the invention may be embodied otherwise without departing from such principles.

What is claimed is:

1. Device for hemming of sheet metals, the device comprising:

a base rack;

a ram arranged in said base rack;

a hemming bed superposed on said ram;

stationary hemming tools, said ram being movable toward and away from said stationary hemming tools;

a compressed air cushion arranged between said base rack and said ram for pneumatically transmitting a working stroke and a hemming force to said ram for hemming sheet metals against said stationary hemming tools, said air cushion being located directly in line with a folded edge arranged at a periphery of said ram so that said hemming force is introduced through said folded edge.

2. A device in accordance with claim 1, wherein:

outer edges of said ram define a ground areas said compressed-air cushion lies in said base rack and covers substantially all of a ground area of said ram.

3. A device in accordance with claim 1, wherein:

outer edges of said ram define a ground area, said compressed-air cushion lies in said base rack and covers substantially all of a ground area of said ram.

4. A device in accordance with claim 1, wherein:

said compressed-air cushion includes a compressed-air hose, said compressed-air cushion is fixed with said compressed-air hose to said ram.

5. A device in accordance with claim 1, wherein:

said compressed-air cushion is fixed with a compressed-air hose at said ram.

6. A device in accordance with claim 2, wherein:

said compressed-air cushion is fixed with a compressed-air hose at said ram.

7. A device in accordance with claim 1, wherein:

a plurality of guide strips are positioned at a periphery of said ram in a direction of movement of said ram in said base rack, said guide strips guide movement of said ram in said direction of movement of said ram in said base rack.

8. A device in accordance with claim 1, wherein:

said base rack defines recesses positioned at a periphery of said ram;

arrest stops are mounted in said recesses, said arrest stops project outwardly and are adjustable for confining said stroke.

9. A device in accordance with claim 1, wherein:

said base rack and said ram define a passage port for connection of a compressed-air hose to said compressed-air cushion.

10. A device in accordance with claim 6, wherein:

a plurality of guide strips are positioned at said periphery of said ram in a direction of movement of said ram in said base rack, said guide strips guide movement of said ram in said direction of movement of said ram in said base rack;

said base rack defines recesses positioned at said periphery of said ram;

arrest stops are mounted in said recesses, said arrest stops project outwardly and are adjustable for confining said stroke;

said base rack and said ram define a passage port for connection of a compressed-air hose to said compressed-air cushion.

11. A device in accordance with claim 1, wherein:

said compressed-air cushion is an expandable and contrastable air fillable container positioned between said ram and said base rack.

12. A device in accordance with claim 1, wherein:

said ram includes a periphery edge zone;

said ram transmits said hemming force from said air cushion substantially evenly along said periphery edge zone of said ram.

* * * * *